United States Patent [19]

Bianchi et al.

[11] 3,998,076

[45] Dec. 21, 1976

[54] ELASTICATED WAIST OPENING

[75] Inventors: Massimo Bianchi; Paolo Conti, both of Florence, Italy

[73] Assignee: Billi, S.p.A., Florence, Italy

[22] Filed: Feb. 14, 1974

[21] Appl. No.: 442,751

[30] Foreign Application Priority Data

Feb. 16, 1973 Italy ..... 9338/73

[52] U.S. Cl. ..... 66/172 E; 66/177

[51] Int. Cl.[2] ..... D04B 9/46

[58] Field of Search ..... 66/107, 172 E, 177, 66/178 R, 178 A, 169 A

[56] References Cited

UNITED STATES PATENTS

| | | | |
|---|---|---|---|
| 3,159,990 | 12/1964 | Monday | 66/172 E |
| 3,241,340 | 3/1966 | Knohl | 66/178 A |
| 3,262,288 | 7/1966 | Burd | 66/172 R |
| 3,670,529 | 6/1972 | Fregeolle | 66/177 |
| 3,673,821 | 7/1972 | Johnson | 66/177 |
| 3,748,870 | 7/1973 | Fregeolle | 66/177 |
| 3,808,842 | 5/1974 | Fisher et al. | 66/177 |
| 3,815,385 | 6/1974 | Gariboldi | 66/177 |

FOREIGN PATENTS OR APPLICATIONS

| | | | |
|---|---|---|---|
| 2,034,010 | 1/1971 | Germany | 66/177 |
| 1,938,623 | 2/1970 | Germany | 66/177 |
| 1,953,235 | 4/1970 | Germany | 66/177 |

OTHER PUBLICATIONS

Santoni, "Thread Through is the Latest Panti-Hose Development," in the Hosiery Trade Journal, p. 13, Sept. 1972.

Goadby; D. R., Billi's Pair of One-Piece Pantie Hose, in the Hosiery Trade Journal, 80(954), pp. 99–100, June 1973.

*Primary Examiner*—Mervin Stein
*Assistant Examiner*—Andrew M. Falik
*Attorney, Agent, or Firm*—Haseltine, Lake & Waters

[57] ABSTRACT

A knitted tubular article such as pantyhose with a longitudinal intermediate cut designed to constitute an opening as for the waist of the pantyhose and for the forming of an elastic edge along said opening. The article is made on a circular hosiery machine, rotating with a continuous motion.

8 Claims, 19 Drawing Figures

FIG. 1A 12 10

| | | | | | | | | | | | | | |
|---|---|---|---|---|---|---|---|---|---|---|---|---|---|
| K | K | K | K | K | t | K | t | K | t | K | t | K | t |
| k | k | k | k | t | k | t | k | t | k | t | k | t | k |
| K | K | K | K | K | t | K | t | K | t | K | t | K | t |
| k | k | k | k | t | k | t | k | t | k | t | k | t | k |
| K | K | K | K | K | t | K | t | K | t | K | t | K | t |
| k | k | k | k | K | t | t | t | K | k | t | k | t | k |
| K | K | K | K | K | K | K | K | K | K | K | K | K | K |
| k | k | k | k | K | t | t | t | K | k | t | k | t | k |
| K | K | K | K | K | K | K | K | K | K | K | K | K | K |
| k | k | k | k | K | t | t | t | K | k | t | k | t | k |

9 7 5

FIG. 5A

| | | | |
|---|---|---|---|
| k | k | k | k |
| t | k | t | k |
| K | t | K | t |
| t | k | t | k |
| K | t | K | t |

| | | | |
|---|---|---|---|
| k | k | k | k |
| t | k | t | k |
| K | K | K | K |
| t | k | t | k |
| K | K | K | K |

FIG. 7A

| | | | | | |
|---|---|---|---|---|---|
| K | K | K | K | K | K |
| K | T | T | T | K | T |
| K | K | K | K | K | K |
| K | T | T | T | K | T |
| K | K | K | K | K | K |

FIG. 9A

| | | | | |
|---|---|---|---|---|
| k | k | k | k | k |
| K | K | K | K | K |
| k | k | k | k | k |
| K | K | K | K | K |

FIG. 11A

| | | | | |
|---|---|---|---|---|
| k | k | k | k | k |
| t | k | t | k | t |
| K | t | K | t | K |
| t | k | t | k | t |
| K | t | K | t | K |

ELASTICATED WAIST OPENING

BACKGROUND OF THE INVENTION

It is known to make tubular articles, specifically one-piece pantyhose on a circular knitting machine which includes means for forming, during knitting, a longitudinal slit destined to become the waist opening in the completed garment. See for example Johnson U.S. Pat. No. 3,673,821. It is also known to incorporate, during knitting of one-piece pantyhose, one or more elastic yarns adjacent the slit for the waist opening, destined to become an elasticized waist band in the completed garment. See for example U.S. Patent Application, Ser. No. 252,011, filed May 10, 1972 by Vincicio Luchi. Difficulty has been encountered in the known prior art in providing sufficient elasticity and in preventing the elastic from unravelling or pulling loose from the fabric of the pantyhose. The problem arises because it is necessary to cut the elastic yarn while the grment is being knit, and the cut ends of elastic tend to be pulled through the stitches of the fabric when the garment is subsequently subjected to the normal handling of pantyhose.

The slit for the waist opening generally extends longitudinally of the garment, or wale-wise as the garment is knit from toe to toe. This is necessary in order to make the opening large enough to be practical when the garment is made on a conventional circular hosiery knitting machine having a needle cylinder of about 4 inches in diameter. The slit is conventionally made during knitting by one of several known methods, including cutting successive stitches in a predetermined length of a selected wale with a specially constructed and actuated sinker. See U.S. Pat. No. 3,564,873. The manner in which the slit is made does not form a part of the present invention, and the invention is applicable to provide an elasticized welt or border for a slit formed in any desired manner during knitting of a tubular fabric on a circular knitting mchine.

SUMMARY OF THE INVENTION

According to the invention, the fabric at least in proximity of the longitudinal slit or cut is formed at two contiquous feed stations. At a first feed station, an end of elastic yarn and an end of fabric yarn is engaged by all the needles, and at a second feed station a fabric or body yarn only is fed to all the needles, but with the needles selected in such a manner that at least 50% thereof pass the second feed at stitch retaining level and the loops formed at the first feed by the combined elastic and fabric yarns are not cast off to form stitches. At the ends of the cut, the fabric is formed by two contiguous feeds, at the first of which an auxiliary non-elastic yarn and an elastic yarn are engaged by alternate needles and the fabric yarn is engaged by all the needles. At the second of said last mentioned contiguous feeds, the fabric yarn is engaged by those intervening needles which did not take elastic yarn at the first of said last mentioned contiguous feeds.

In a practical embodiment, a contiguous zone of fabric to the aforesaid band is formed with a plain stitch with courses of stitches formed with elastic yarn combined with the fabric yarn, alternated with courses of stitches formed with only the yarn of the fabric.

The fabric adjoining the ends of the cut may be formed with the fabric yarn at two contiguous feeds on all the needles and with an elastic yarn and a non-elastic yarn fed at one feed for engagement by selected needles.

Said hand adjacent the cut may be formed entirely with courses of stitches wherein the elastic yarn is engaged by all the needles. Alternatively, said band adjacent the cut in the fartherest portion from the cut may be formed with a 1:1 selection or equivalent of the needles which engage the elastic yarn, the selection being changed in the contiguous feeds.

OBJECTS OF THE INVENTION

It is an object of the invention to provide an improved one-piece pantyhose wherein the opening for the waist is formed by a longitudinal slit made walewise of the fabric during knitting, and an elastic waistband is knit in coursewise of the fabric and defining the marginal edges of the walewise extending opening during knitting of the garment.

It is a further object of the invention to provide a product of the type described wherein the elastic yarn is incorporated into the fabric in three different longitudinally extending zones contiquous to each other on each side of the longitudinally extending cut. The zones are differentiated from each other by the stitch structure and more specifically by the manner in which the elastic yarn is knit in the fabric in each of said zones.

It is a more specific object of the invention to provide a product of the type described wherein the elastic yarn and a non-elastic yarn are both fed to the same selected needles in each of the said three zones of fabric bordering the cut.

It is an object of the invention to provide a product of the type described wherein the stitch structure incorporating the elastic into the fabric of the specified zones of the garment enhances the elasticity and stabilizes the fabric and improves the comfort and fit of the garment.

BRIEF DESCRIPTION OF THE DRAWINGS

The invention will be better understood following the description and the accompanying drawing, which illustrates a preferred embodiment not restricting the scope of the invention. In the drawings:

FIG. 1A is a diagrammatic illustration of the loop structure at the interfaces of the zones;

FIG. 5A is a diagrammatic illustration of the loop structure corresponding to FIG. 5;

FIG. 7A is a diagrammatic illustration of the loop structure resulting from the FIG. 6 needle set up.

FIG. 9A is a diagrammatic illustration of the loop structure corresponding to FIG. 9;

FIG. 11A is a diagrammatic illustration of the loop structure corresponding to FIG. 11;

Figure 1:
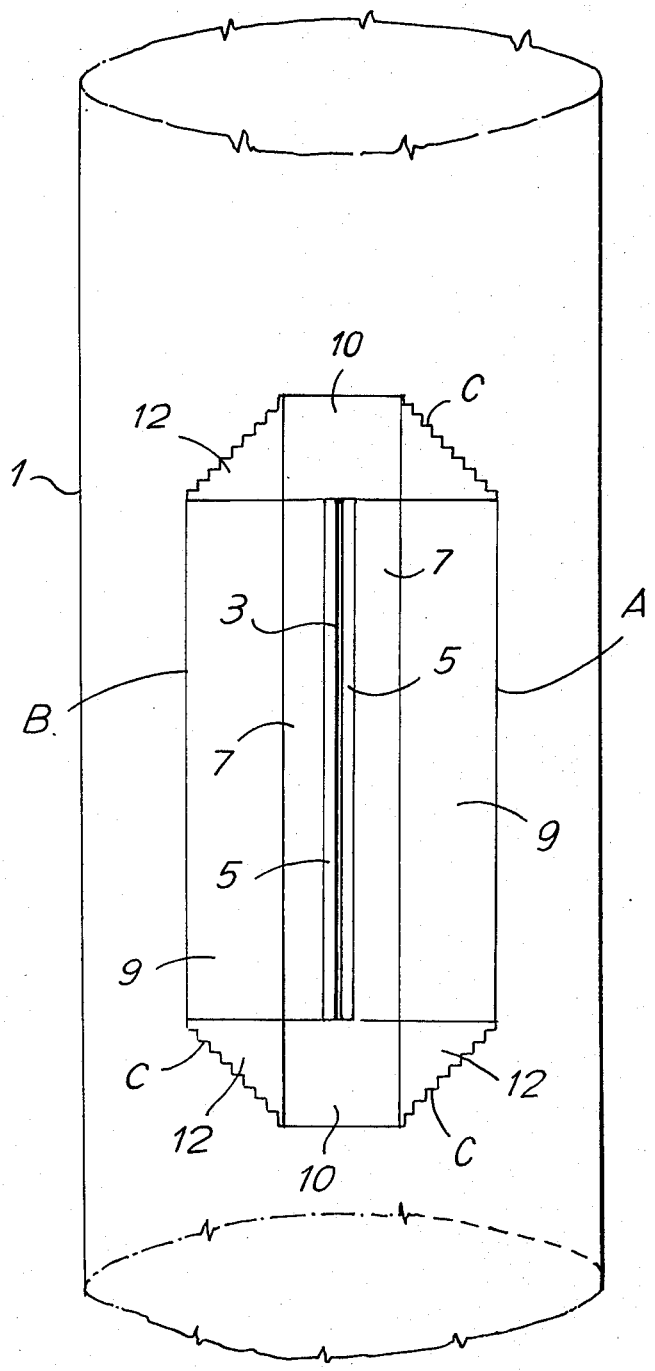
FIG. 1 diagrammatically illustrates the central portion of a tubular article such as the body portion of a one-piece pantyhose, with parts broken away, and illustrating schematically and on an enlarged scale a longitudinal cut for the waist opening and the zones of elasticized and stabilizing fabric bordering the cut.

Referring more specifically to the drawings, the reference numeral 1 denotes the tubular article which is in the preferred embodiment a one-piece pantyhose and in which a longitudinal slit, cut or opening 3 is made in the fabric during the continuous circular motion of the needle cylinder of a hosiery machine. A cut of this kind serves for the waist opening in the completed pantyhose and is formed by any desired method including those described in U.S. Pat. No. 3,673,821 to Johnson and in U.S. Pat. No. 3,564,873.

On each side of the cut 3 there is a group of elongated rectangular fabric zones, each of which extends longitudinally of the fabric coextensively with the cut 3. Immediately bordering the cut 3 is a first zone of fabric 5 in which elastic yarn is knit and anchored to form an elastic band bordering the opening formed by the cut 3. The zone 5 is, as indicated in FIG. 1, narrow in the coursewise direction or transverse dimension in FIG. 1. Immediately bordering the zones 5 on each side of the cut 3 is a relatively wider fabric zone, indicated at 7 in FIG. 1. Spaced outwardly from and in adjoining relation to the zone 7 on both sides of the cut 3 are fabric stabilizing zones 9. The zones 9 are relatively wider in a coursewise direction than the zones 7.

In practice, the zones 5 and 7 are relatively narrow and are structured in such a manner as to roll up upon themselves defining a longitudinal marginal border for the cut 3 and assuming an arrangement which enhances the stability of the stitches bordering the cut 3. The zone 9 defines in the finished garment, as most clearly seen in FIG. 14, a stabilizing or reinforcing band, which may simulate an elastic band and indeed provides some elasticity, although it is the function of the zones 5 and 7 to provide the required elasticity adjoining the cut 3.

At each end of the cut 3 there is formed a zone 10 knit in such a way as to assure the stability of the stitches longitudinally of the fabric or walewise. Said zones 10 are each flanked by generally triangular zones 12 which also border the ends of the zones 9 and are made with step reductions. The distal longitudinal edges of the zones 9 and the stepped portions of the zones 12 are defined by the shearing of the elastic yarn, at lest, which is knitted together with the fabric yarn. In certain zones, at least, beside the addition of the elastic yarn, there is also provided an additional non-elastic yarn. This applies particularly for the zones 10 and 12.

Figure 14:
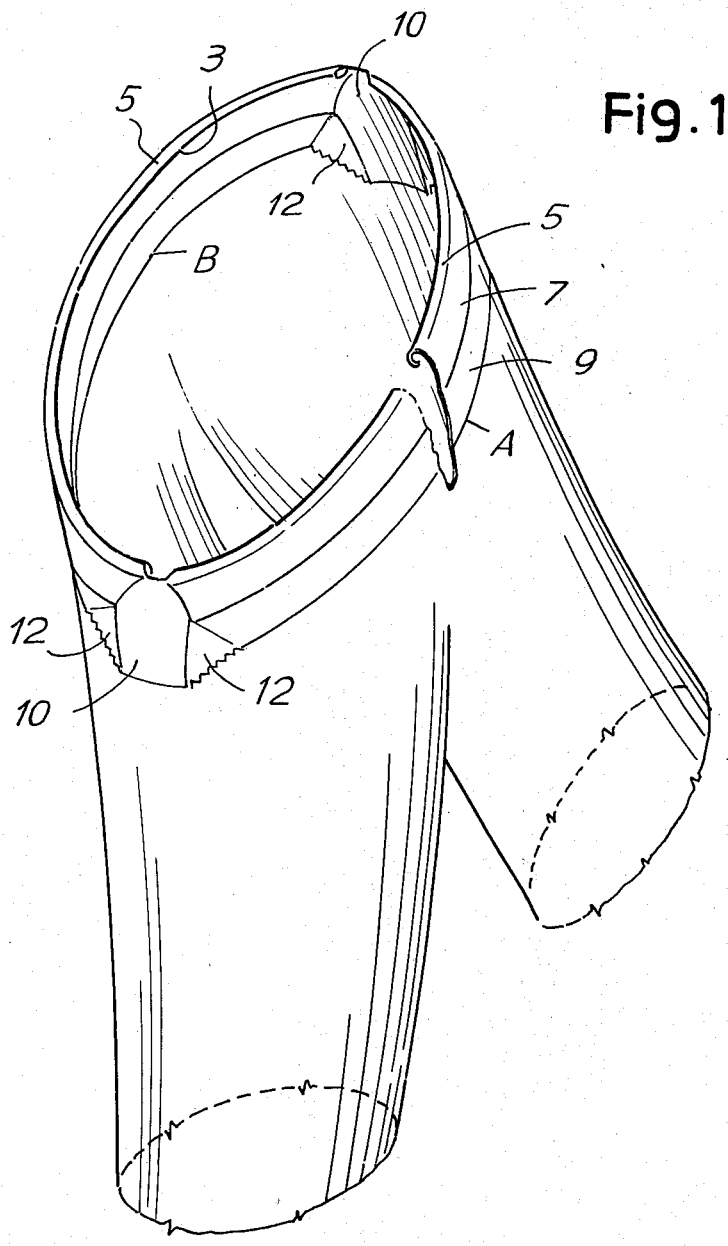
FIG. 14 illustrates diagramatically the body portion of a garment with part of the waistband being cut away to illustrate the tendency of the free edge of the waistband to roll upon itself and incorporating the fabric illustrated in the preceding figures.

The proportion of the several zones from 5 to 12 with respect to the other zones and with respect to the article is altered for clarity of understanding of the invention. Actually, the zones 9 form together with the zones 12 and 10, a continuous elasticized and stabilizing band around the opening of the waist formed by the cut 3. In FIG. 14 it is shown how the several zones are arranged in the wearing of the garment.

FIG. 1A diagrammatically illustrates the loop structure at the interfaces of the zones and in the figure, K designates a knitting with two yarns, k a knitting with one yarn, and t a tuck. The same representation is shown in FIGS. 3A, 5A, 7A, 9A and 11A.

Figure 2:
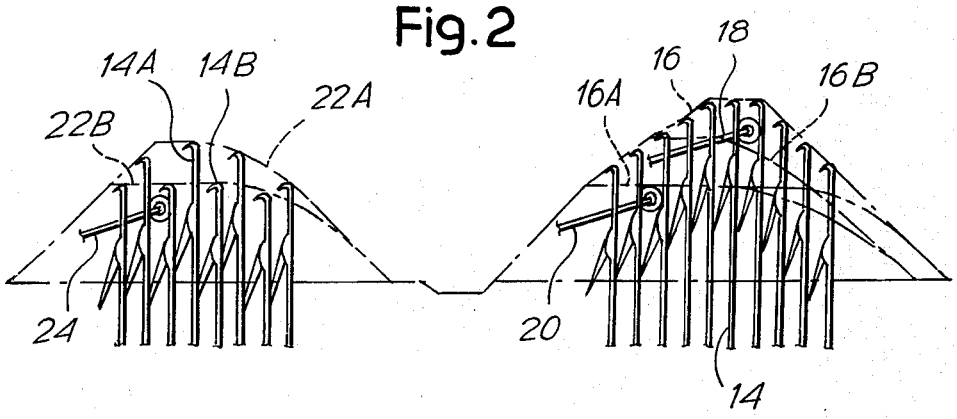
FIG. 2 illustrates the array of the needles at a first pair of contiguous feeds.

In order to obtain the several zones with the above indicated requirements of elasticity and of anchoring of the elastic yarns; of providing for a rolling up along the longitudinal edges of the cut 3, and of resistance to ladders both along the courses and at the end of the cut or slit 3, the several zones may be knit as follows:

Referring to the right side of FIG. 2 there is illustrated a first yarn feed station or feed of a pair of contiguous yarn feed stations or feeds wherein cylinder needles 14 are raised to follow the profile indicated at 16, so as to engage an elastic yarn 18 fed in a raised position and a non-elastic yarn 20, which is the body yarn or fabric yarn used for the forming of the pantyhose. The second feed of said contiguous pair of yarn feeds is shown on the left side of FIG. 2 wherein alternate needles 14A and intervening needles 14B are raised according to the two profiles 22A and 22B respectively, to clear the elastic yarn loops on needles 14A and retain the elastic yarn loops on the needles 14B. The pattern of needle selection may be varied as desired within the spirit of the invention and need not be alternate needles as shown in FIG. 2, except that it is preferred to retain the elastic yarn loops on at least 50% of the needles at the second of said two contiguous feeds. A non-elastic yarn 24 is fed to all the needles at the said second feed shown on the left side of FIG. 2. After the zones 5, 7, and 9 have been formed, the needle trajectory is modified, and the needles traverse a lower path denoted by 16A and/or by 16B to engage only the yarn 20 and not the yarn 18, while the yarn 24 may be engaged with a desired needle selection which may be that indicated in FIG. 2, or another appropriate one, such as a plain stitch, wherein all the needles outside the zones 5, 7, and 9 follow the trajectory 22A.

Figures 3, 3A:
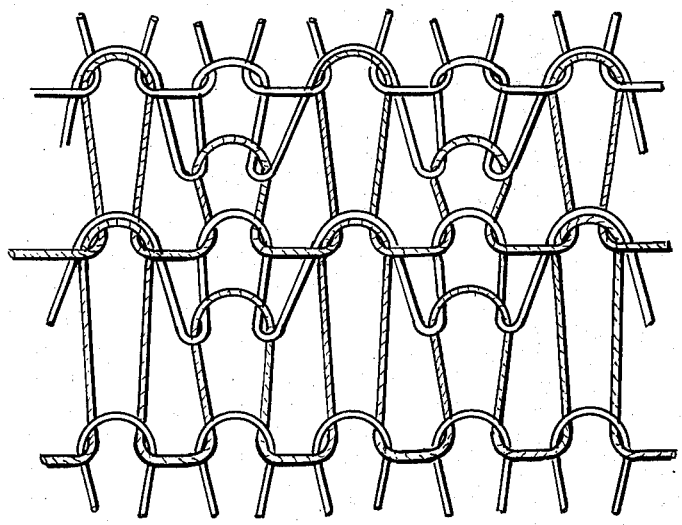
FIG. 3 illustrates the structure of the fabric formed at said first pair of feeds immediately adjacent the cut.
FIG. 3A is a diagrammatic illustration of the loop structure corresponding in FIG. 3.

FIG. 3 shows the yarns 18 and 20 combined in individual stitches and the yarn 24 forming loops in several courses, with the array of the loops resulting from the selection of the needles 14A and 14B. The now described interlacing or looping has the characteristic of good elasticity, a good seal or resistance against the cross-wise drawing off or unravelling of the cut elastic yarns. Moreover, it tends to roll up.

Figure 4:
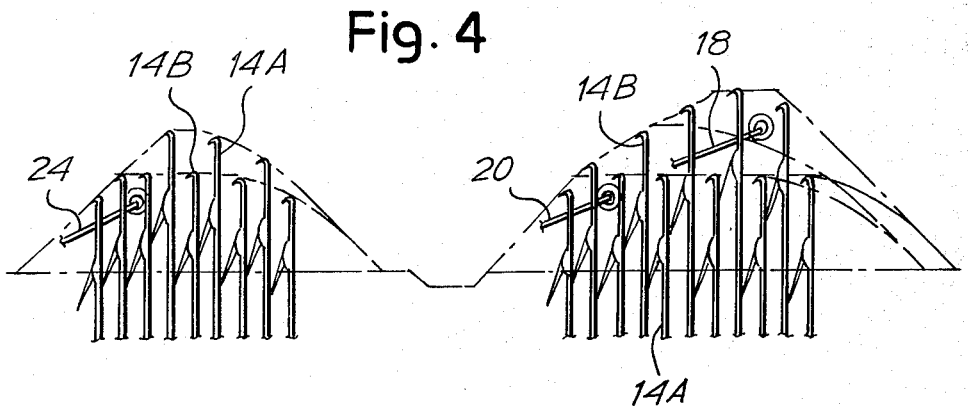
FIG. 4 is a view similar to FIG. 2 illustrating the array of the needles at a second pair of contiguous feeds.
Figure 5:
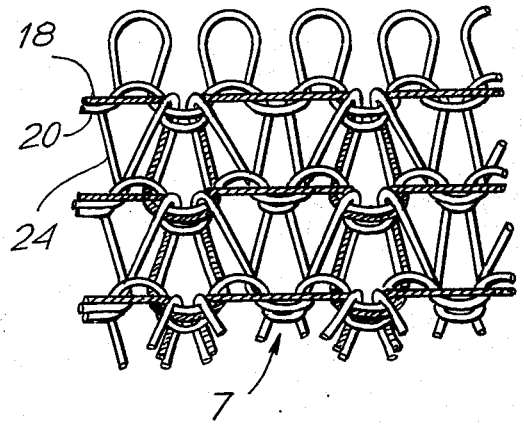
FIG. 5 shows the fabric formed at said second pair of feeds.

FIGS. 4 and 5 illustrate the forming and the stitch array of the zones 7. In the feed shown at the right of FIG. 4, the elastic yarn 18 is fed in a raised position and the fabric yarn 20 in a lowered position. Said intervening needles 14B are raised to take the elastic yarn 18 and also the fabric yarn 20, while said alternate needles 14A are only partially raised to take only the fabric yarn 20 and not cast off the previous stitch, but retain the previous loop above the latch. In the feed shown at the left of FIG. 4, the needle profile is the same as the profile of the feed shown at the left of FIG. 2 wherein all the needles take the non-elastic yarn 24, but the needles 14A are fully raised to cast off their stitches and the needles 14B are raised to only tuck position and retain their stitches.

The needles selection for zone 7 is substantially similar to the needle selection at the two contiguous feeds illustrated in FIG. 2, but it is reversed in the sense that in the right hand feed of FIG. 4 the needles previously cleared as shown at the left hand feed of FIG. 2 are kept in a tuck position, and the needles shown to be kept in a tuck position at the left hand of FIG. 2 are cleared at the right of FIG. 4.

The structure of the fabric in the zones 7 is the one shown in FIG. 5.

Figure 6:
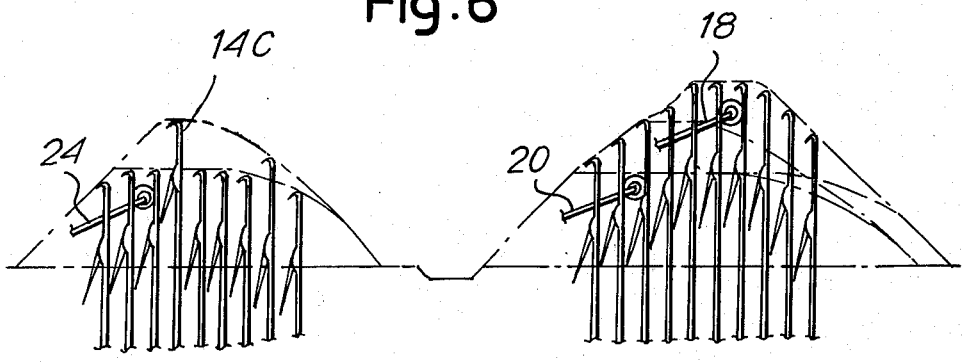
FIG. 6 is similar to FIG. 4 and illustrate a modified form which may also be used adjacent the cut.

An alternative to the structures shown in FIG. 5 and formed with the arrangement of FIG. 4 to provide the construction of the zones 7 is shown in FIG. 7A, it being made with the needle array of the feeds shown in FIG. 6. In this variation, at the right hand feed of FIG. 6, in correspondence of the feeding of the elastic and non-elastic yarns 18 and 20, respectively, all the needles are raised, while at the left hand feed in FIG. 6 in correspondence of the feed of the non-elastic yarn 24 only one needle (14C) of every four needles is raised.

The structure shown in FIG. 7A with the arrangement of FIG. 6 may also be adopted for the forming of the zones 5 as well as for the forming of the zones 7A.

The two stitch constructions shown in FIGS. 5 and 7A both have the feature of good longitudinal elasticity and a tendency of rolling up. The construction of zone 5 according to FIG. 7A, like that of FIG. 3, also has a good resistance to unravelling of the elastic yarns cut along the marginal edges of the slit 3.

Figure 8:
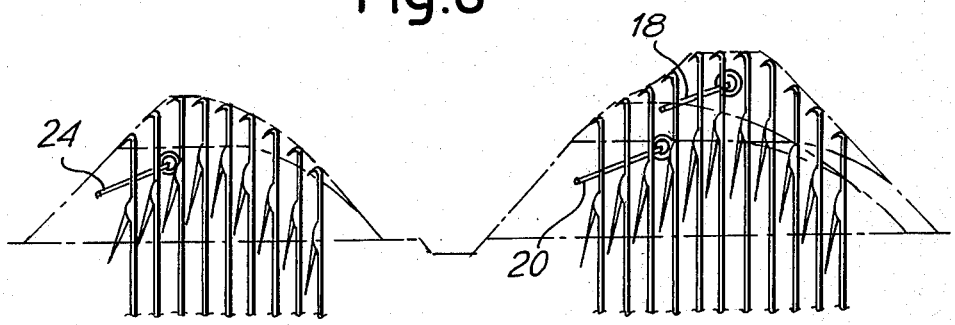
FIGS. 8 and 9 illustrate, respectively, as in the preceding figures, the array of the needles in correspondence of two contiguous feeds and the structure of the fabric in a band surrounding the previously indicated zones.
Figure 9:
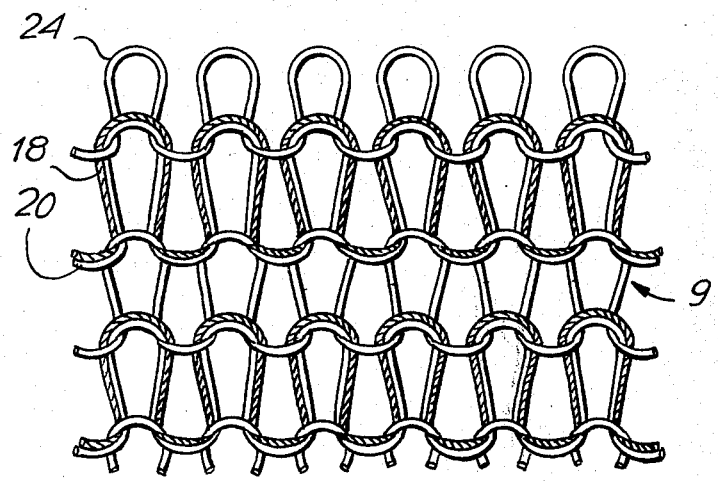

For the forming of the zones 9, the array shown in FIG. 8 is adopted and the structure obtained is the one shown in FIG. 9. In order to obtain the zones 9, all of the needles are raised at the right of FIG. 8 in correspondence of the feed of the yarns 18 and 20 which are both engaged by all the needles, while at the left hand feed of FIG. 8 once again all the needles are raised to pick up the yarn 24. This construction has a poor longitudinal elasticity, but it stabilizes the fabric when worn as a garment, and it simulates an elastic belt.

Figure 10:
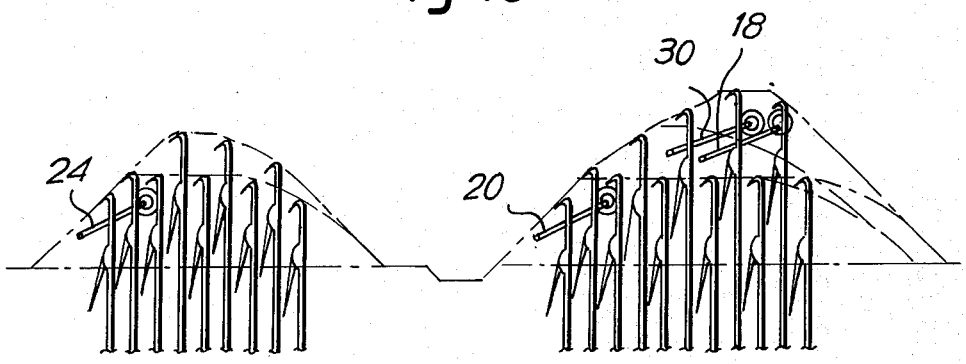
FIGS. 10 and 11 illustrate, respectively, as in the preceding figures, the array of the needles in correspondence of two contiguous feeds and the structure of the fabric at the ends of the cut.
Figure 11:
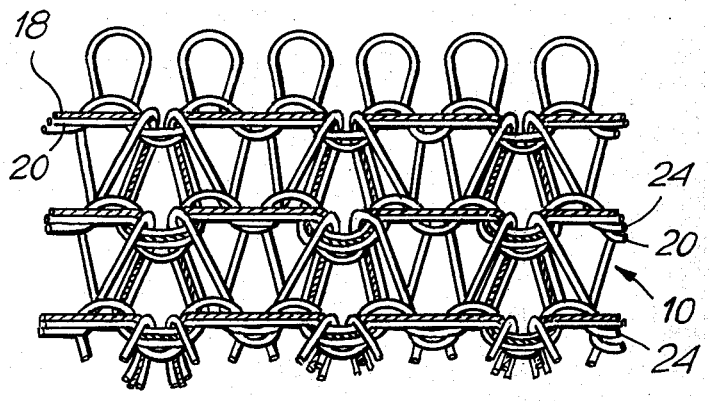

FIGS. 10 and 11 show the condition for the forming of the zones 10 at both ends of the cut 3. In the knitting of these zones there is provided, as shown on the right side of FIG. 2, the insertion of a supplemental yarn-guide for an additional or auxiliary yarn 30 fed at the same level as the elastic yarn 18. Again, the non-elastic yarn 20 is fed in a lower position. The additional yarn 30 may be a non-elastic yarn such as the yarn 20. The needle selection in the knitting of zones 10 is the same as shown in FIG. 4 and the resulting structure is shown in FIG. 11. This structure assures the stability of the stitches against the undoing of the fabric at the ends of the cut or slit 3.

Figure 12:
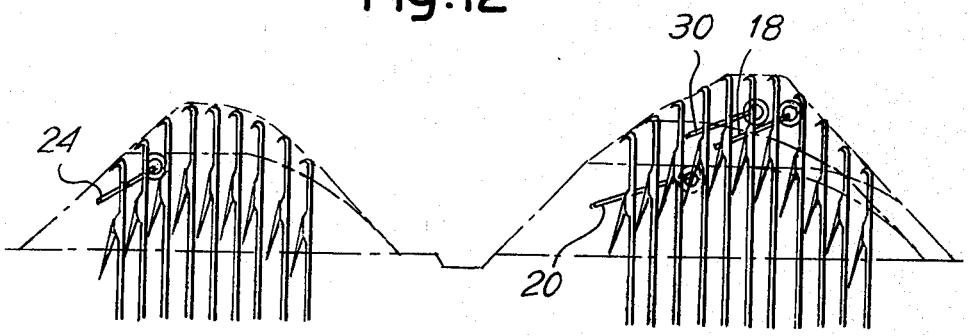
FIGS. 12 and 13 illustrate, respectively, as in FIGS. 10 and 11, the array of the needles in correspondence of contiguous feeds and the structure of the fabric produced.
Figure 13:
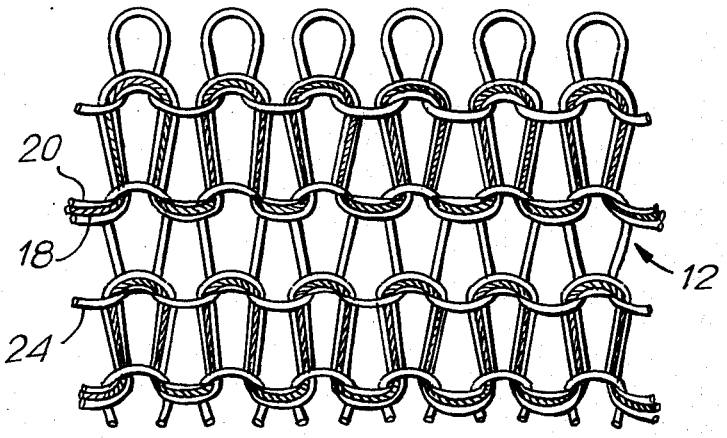

Referring to FIG. 1, there will be observed triangular zones 12 adjoining and extending between the wales defining the lateral edges of the end zones 10 and the courses defining the end edges of the stabilizing zones 9. The triangular zones 12 have the function of joining the zones 9 and 10 of the elastic band to complete the peripheral stabilization of the fabric adjacent the cut 3. Zones 12 are formed with the same array of yarn-guides as shown in FIG. 10, but using the needle selection shown in FIG. 12. As shown in FIG. 10 (right side), there is fed in correspondence of a feed the elastic yarn 18 and the non-elastic yarn 30 in a raised position and the non-elastic yarn 20 in a lower position. All the needles engage the yarns as shown in FIGS. 8 and 12. The resulting fabric of zones 12 is shown in FIG. 13 and is similar to the construction of zones 9 as shown in FIG. 9, except that an additional yarn is added in the triangular bridging zones 12 for strengthening the points of stress adjacent the ends of the cut 3.

It will be understood that the remainder of the tubular article will be knit in any desired manner, and in the preferred embodiment of a one-piece pantyhose the area of the garment which has been described is that part of the body or panty portion adjoining the waist opening defined by the cut 3. The remainder of the body portion and the legs and foot portions (not shown) of the pantyhose may be knit in any desired manner to complete the garment. According to the invention, there is provided in the area of the waist opening a fabric made in several zones which has the characteristics already indicated and which cooperates to provide a well anchored knitted in elastic at the zones 5 bordering the longitudinal marginal edges of the cut 3. The narrowness and elasticity of the zones 5 provide a protective curling effect which guards against unravelling of the knitted in elastic. In the zones 7 good elasticity is obtained because the elastic loops are connected with one another and thus one obtains the maximum elasticity of the fabric with the minimum of feeds of elastic yarns. A curling effect is also obtained.

In the zones 9 there is no curling effect and a slightly reduced, but still efficient, elasticity is provided. The zones 9 form a stabilizing peripheral band near the waist opening. The high degree of elasticity obtained in zones 5 and 7 is made possible with a minimum of elastic, it being noted that elastic is fed at only alternate feeds in each of the constructions of zones 5 and 7, by retaining the elastic on at least 50% of the needles at the feeds which provide only non-elastic yarn and thereby creating continuous rows of loops with elastic yarn, which are responsible for an efficient elasticizing. The yarns 20 and 24 are the body yarns or fabric yarns from which the tubular fabric 1 is made. The yarns 18 and 30, respectively an elastic yarn and a non-elastic yarn, only contribute to the forming of the zones 5, 7, 9, 10 and 12 and are then cut along the edges A, B, and along the step profiles C (see FIG. 1) by known systems.

In the drawings and specification, there has been set forth a preferred embodiment of the invention and, although specific terms are employed, they are used in a descriptive sense only and not for purposes of limitation, the scope of the invention being defined in the claims.

I claim:

1. A tubular knit article having opposite ends and a longitudinal cut extending wale-wise and terminating between said ends, and a plurality of elongated zones bounding the longitudinal marginal edges of said cut and extending only partially around the circumference of the tubular article, each said zone extending course-wise and transversely of said longitudinal cut, said zones including a first zone immediately proximate said cut and including interknitted elastic and fabric yarn forming an elastic band, a second zone bordering said first zone and including interknitted elastic and fabric yarn and a third zone bordering said second zone and including interknitted elastic and fabric yarn, said first zone including successive courses in which said elastic yarn and a first fabric yarn are interknitted with a second fabric yarn, said first zone being knitted to provide a tendency to roll upon itself at said cut along the longitudinal edges thereof while said third zone is knitted to have the tendency to remain flat, said third zone being formed by plain knit stitches with courses of stitches comprising said elastic yarn and said first fabric yarn alternating with courses of stitches formed only with said second fabric yarn, said first zoned being narrower in width in the coursewise direction than the other two zones.

2. An article as claimed in claim 1 wherein said second fabric yarn is alternately tucked one wale in each course and said elastic yarn and first fabric yarn are interknitted in combination over two courses with the second fabric yarn at the tucks thereof.

3. An article as claimed in claim 1 further comprising end zones bounding said three elongated zones at the ends thereof.

4. An article as claimed in claim 3 wherein each of said end zones bounding the end of the three elongated zones includes a fourth zone extending coextensively course-wise with the first and second elongated zones, and a fifth zone laterally bounding each fourth zone at a respective side thereof and extending coextensively course-wise with the third elongated zone.

5. An article as claimed in claim 4 wherein each fifth zone is substantially of triangular shape.

6. An article as claimed in claim 1 wherein said elastic and first and second yarns are knitted in said first zone by feeding the elastic yarn and said first fabric yarn to all the needles of the zone at a first of two contiguous yarn feed stations spaced circumferentially about a needle cylinder, and feeding the second fabric yarn to all of the needles of this zone at the second of the contiguous yarn feed stations while the combined elastic and first fabric yarn are retained on at least 50% of the needles at the second station.

7. An article as claimed in claim 4 wherein elastic and first and second yarns are knitted in said fourth end zones by feeding the elastic yarn and an additional yarn to alternate needles in a first of two contiguous yarn feed stations spaced circumferentially about a needle cylinder while the first fabric yarn is fed to all of the needles at said first station, and the needles which do not seize the elastic yarn nor the additional yarn are at a tuck level, said second fabric yarn being fed at the second station to all the needles whereas the alternate needles which engaged the elastic yarn at the first station, are at a tuck level.

8. An article as claimed in claim 1 wherein said first, second and third zones have successively increased width in the course-wise direction.

* * * * *